United States Patent [19]

Kunde et al.

[11] Patent Number: 5,034,017

[45] Date of Patent: Jul. 23, 1991

[54] PROCESS FOR THE COLORING OF PAPER WITH DISAZO DYES CONTAINING SULFONATED-NAPHTHOL GROUPS TO GIVE FAST BLUE SHADES

[75] Inventors: Klaus Kunde, Neunkirchen; Peter Wild, Odenthal, both of Fed. Rep. of Germany

[73] Assignee: Bayer Aktiengesellschaft, Leverkusen, Fed. Rep. of Germany

[21] Appl. No.: 497,371

[22] Filed: Mar. 21, 1990

[30] Foreign Application Priority Data

Apr. 5, 1989 [DE] Fed. Rep. of Germany ..... 3910923

[51] Int. Cl.[5] ..... D21H 21/28; C09B 35/04

[52] U.S. Cl. ..... 8/681; 8/636; 8/687; 8/919; 106/20; 106/22

[58] Field of Search ..... 8/681, 687, 919; 106/22

[56] References Cited

U.S. PATENT DOCUMENTS 4,724,001 2/1988 Ohta et al. ..... 106/22

FOREIGN PATENT DOCUMENTS 289458 11/1988 European Pat. Off. .

379978 8/1990 European Pat. Off. .

*Primary Examiner*—A. Lionel Clingman

*Attorney, Agent, or Firm*—Sprung, Horn, Kramer & Woods

[57] ABSTRACT

Dyestuffs of the formula (I)

in which the substituents have the meanings given in the description are highly suitable for the coloration of paper. They produce light and wetfast blue coloring.

3 Claims, No Drawings

PROCESS FOR THE COLORING OF PAPER WITH DISAZO DYES CONTAINING SULFONATED-NAPHTHOL GROUPS TO GIVE FAST BLUE SHADES

The present invention relates to a process for the coloration of paper, which is characterized in that dyestuffs of the formula

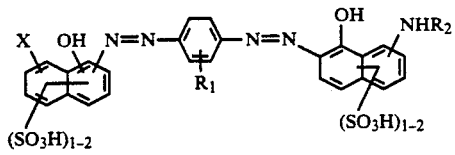

(I)

are used in which

X is H, OH, $C_1$–$C_4$-alkoxy or —$NHR_3$ $R_1$ is H, $C_1$–$C_4$-alkyl $R_2$, $R_3$ are H, alkyl, alkylcarbonyl, alkylsulphonyl, aryl, arylcarbonyl, arylsulphonyl, aralkyl, aralkylcarbonyl or aminocarbonyl.

The substituents mentioned can in turn be substituted by substituents customary in dyestuff chemistry, for example halogen, in particular Cl, OH, $C_1$–$C_4$-alkoxy, acyloxy, for example acetoxy, $C_1$–$C_4$-alkyl, $SO_3H$, COOH.

Alkyl preferably represents substituted or unsubstituted $C_1$–$C_4$-alkyl, aryl, preferably substituted or unsubstituted phenyl and aralkyl, preferably substituted or unsubstituted benzyl.

Preferred dyestuffs I are very generally those in which $R_1$ is H, $C_1$–$C_4$-alkyl, $R_2$, $R_3$ are H, $C_1$–$C_4$-alkylcarbonyl, $C_1$–$C_4$-alkylsulphonyl, aminocarbonyl, phenylcarbonyl, phenyl, phenylsulphonyl, benzylcarbonyl, it being possible for the phenyl rings also to be substituted by $SO_3H$ or COOH, X is H, $C_1$–$C_2$-alkoxy, —$NHR_3$, OH, the dyestuffs having at least 3 sulpho groups in the naphthalene rings.

Preferred dyestuffs are furthermore those of the formulae

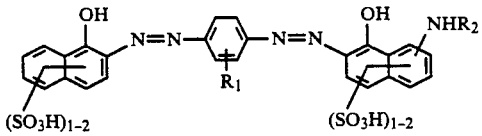

(II)

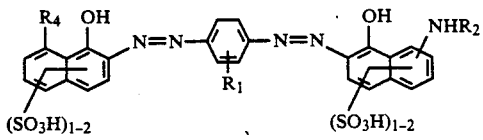

(III)

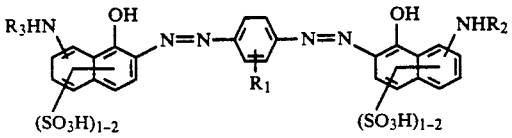

(IV)

in which $R_1$–$R_3$ have the meaning given in formula I, in which $R_1$ is preferably H or $CH_3$ $R_2$, $R_3$ are preferably H, $COCH_3$, $COC_6H_5$, $C_6H_5$ and in which $R_4$ is OH, $OCH_3$, $OC_2H_5$.

The dyestuffs are prepared in a known manner by coupling diazotized azo dyestuffs of the formula

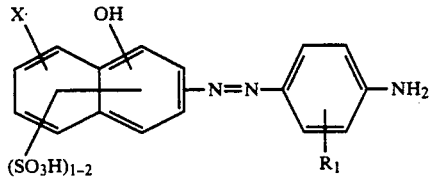

(V)

onto coupling components of the formula

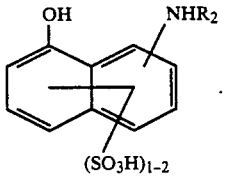

(VI)

In the case where X is $NH_2$, it is advantageous to prepare them by using the corresponding compounds V in which X is acylamino, in particular —$NHCOCH_3$, and hydrolyzing the product, after the coupling reaction is completed.

The dyestuffs are in general used for the coloring in the form of their salts, in particular the alkali metal salts (Li, Na, K), the ammonium salts, Mono-, bis-or tris - $C_2$–$C_4$-alkyl ammonium salts, in particular also the $C_2$–$C_4$-alkanol ammonium salts. The preferred ammonium salts are those having the cation $$R_6-\overset{(+)}{N}(R_5)_3$$

in which $R_5$ is H, $C_1$–$C_4$-alkyl, which may be substituted by OH or hydroxy-$C_1$–$C_4$-alkoxy, in particular $CH_3$, $C_2H_5$, $C_2$—$CH_2$–OH, $CH_2$—$CH_2OCH_3$, $CH_2$—$CH_2$–$OCH_2$–$CH_2OH$, $R_6$ is $C_1$–$C_4$-hydroxyalkyl, $C_1$–$C_4$-hydroxyalkoxyalkyl, in particular $CH_2$—$CH_2$–OH, $CH_2$—$CH_2OCH_3$, $CH_2$—$CH_2$–$OCH_2$–$CH_2$–OH.

The radicals $R_5$ can be identical or different.

The dyestuffs can also be used in the form of concentrated aqueous solutions.

They can be used in all processes customary for substantive dyestuffs in the paper industry, in particular in pulp and surface coloring of paper for sized and unsized grades, starting from bleached or unbleached pulp of different provenience such as softwood or hardwood sulphite and/or softwood or hardwood sulphate pulp.

The blue paper coloring obtained are distinguished by good light and wet fastness (bleeding fastness) and acid, alkali and alum fastness. The brilliance and clarity of the shades may also be mentioned. Furthermore, their combination behavior with suitable dyestuffs is very good.

EXAMPLE A

Dry matter consisting of 60% of mechanical wood pulp and 40% of unbleached sulphite pulp is beaten in a Hollander and milled to a milling degree of 40° SR, resulting in a dry solids content of slightly above 2.5%, and then brought to a dry solids content of the stock of 2.5%.

5 parts of a 0.5% strength aqueous solution of the dyestuff of the formula

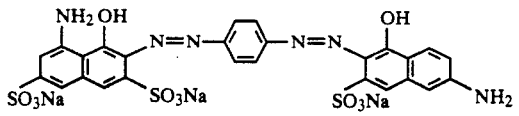

(1)

are added to 200 parts of this stock, the mixture is stirred for about 5 minutes, 2% of resin size and 3% of alum (relative to the dry matter) are added, and the mixture is again stirred for a few minutes until it is homogeneous. It is then diluted with about 500 parts of water and used to produce paper sheets in a conventional manner by sucking through a sheet former. The paper sheets have a blue coloring. The wastewater is virtually free of dyestuff.

EXAMPLE B

When unsized paper material is colored under otherwise identical coloring conditions, a strong blue coloring in combination with virtually dyestuff-free wastewater is also obtained.

EXAMPLE C

If bleached sulphite pulp is used for preparing the stock, and this stock is used for the coloring, blue paper colorings and virtually dyestuff-free wastewater are obtained by the abovementioned method.

If the dyestuffs (2) to (73) below are used instead of the dyestuff mentioned in Example A, blue paper colorings and virtually dyestuff-free wastewater are also obtained.

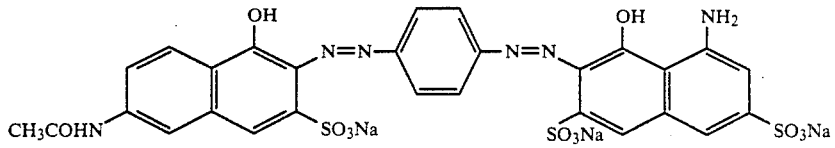

(2)

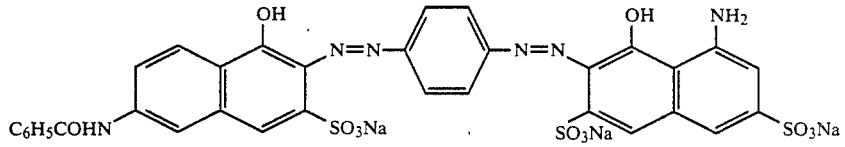

(3)

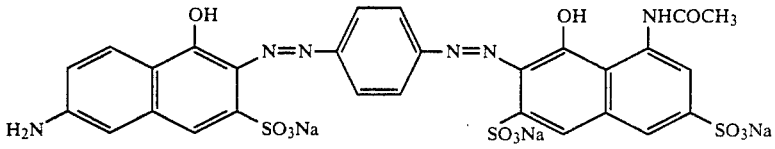

(4)

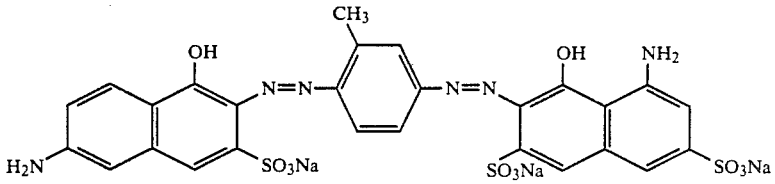

(5)

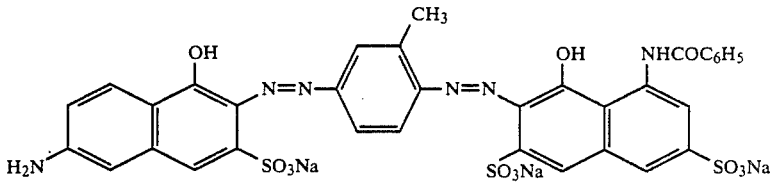

(6)

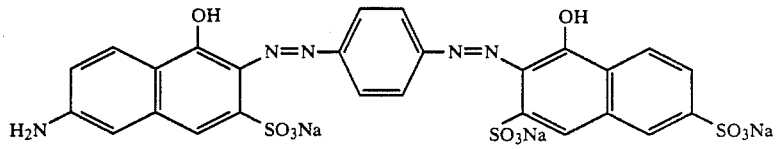

(7)

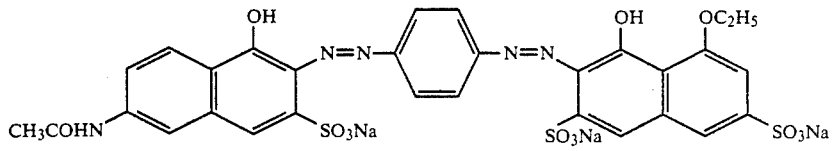

(8)

-continued
(9)
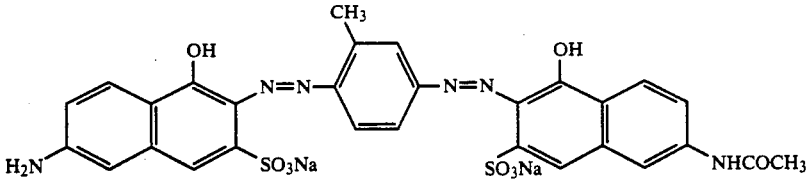
(10)
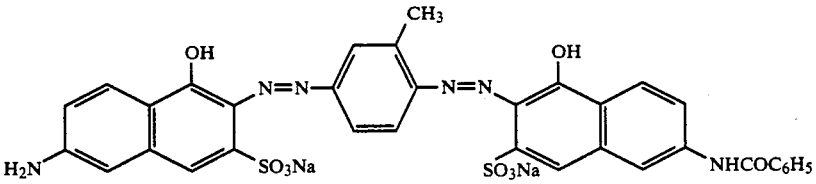
(11)
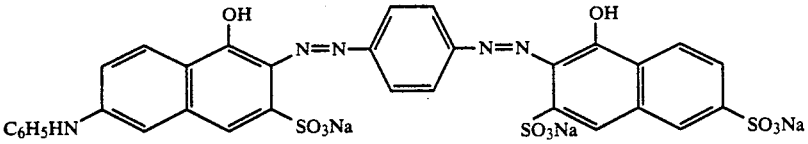
(12)
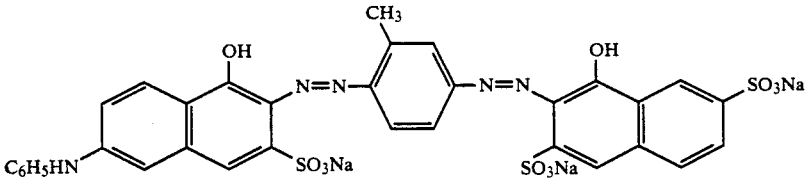
(13)
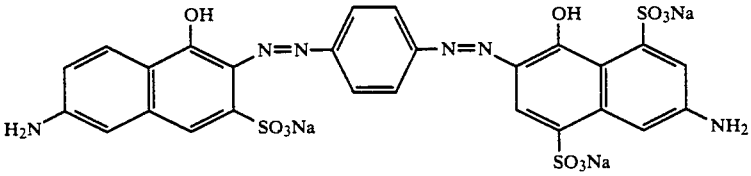
(14)
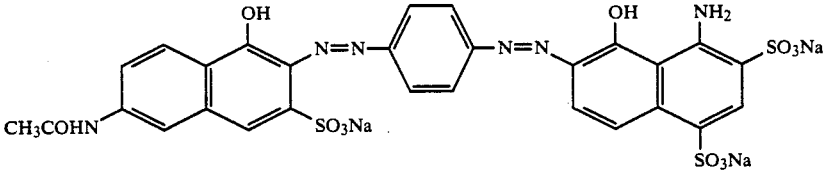
(15)
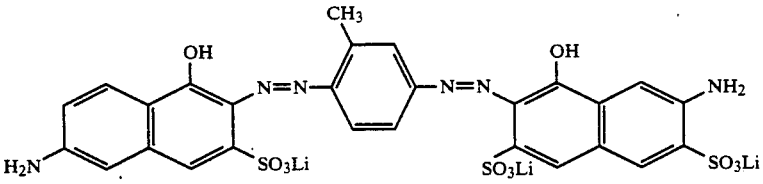
(16)
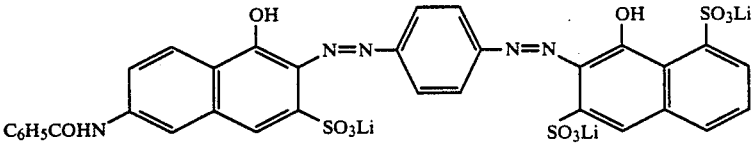
(17)
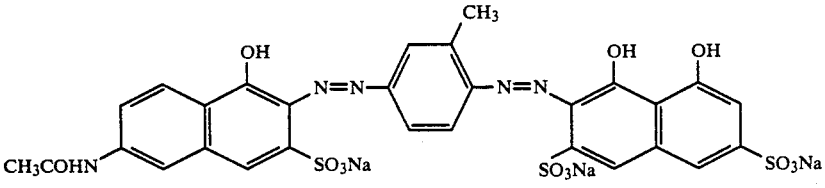

-continued
(18)
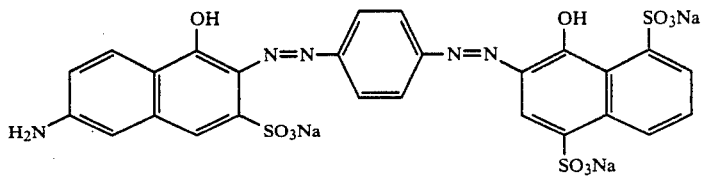
(19)
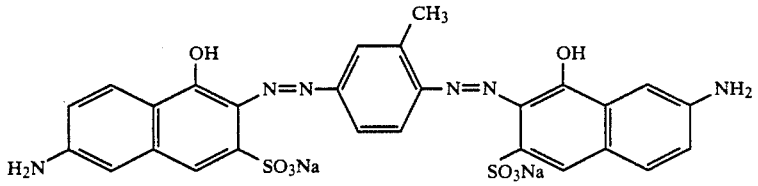
(20)
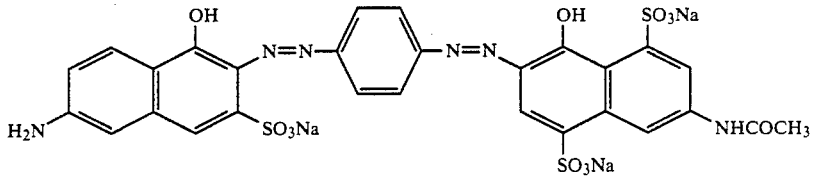
(21)
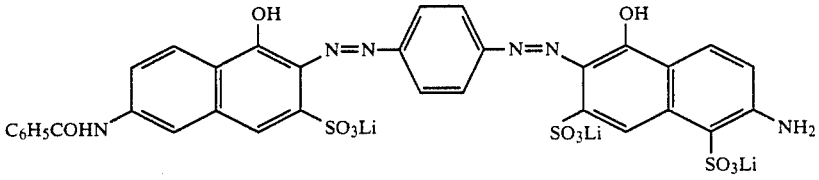
(22)
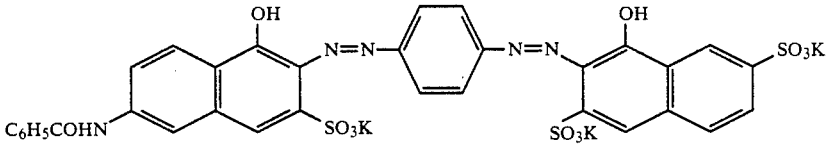
(23)
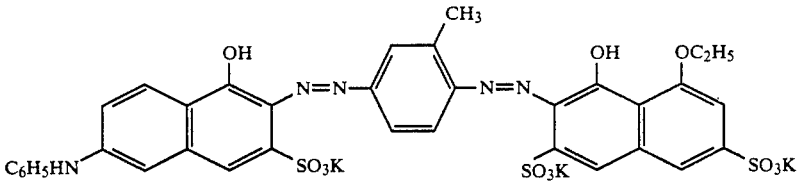
(24)
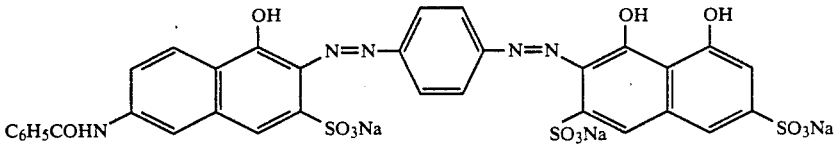
(25)
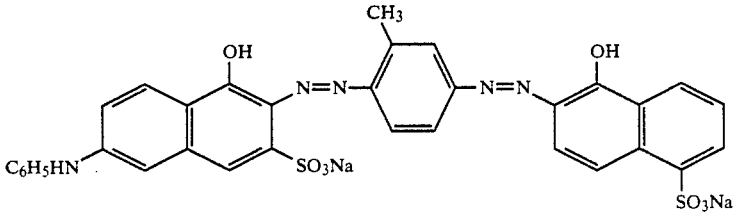

-continued
(26)
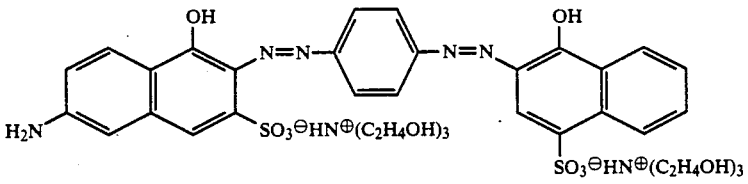
(27)
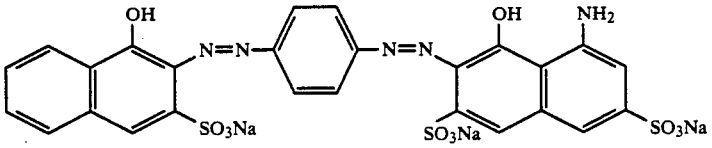
(28)
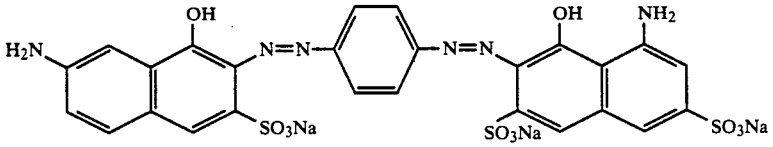
(29)
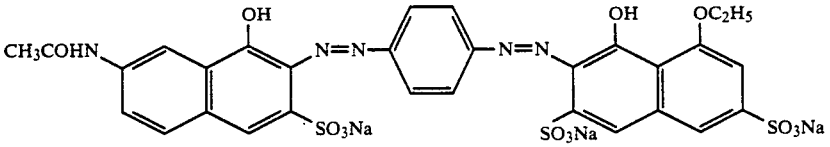
(30)
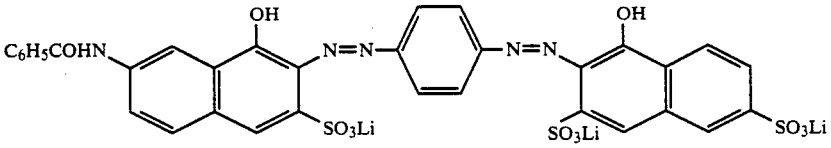
(31)
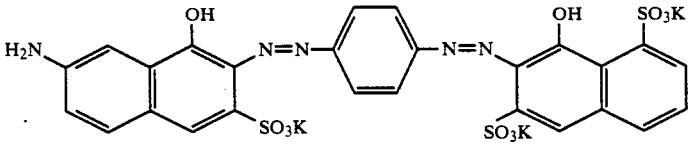
(32)
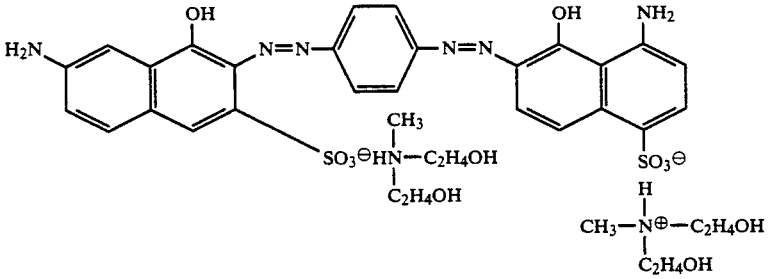
(33)
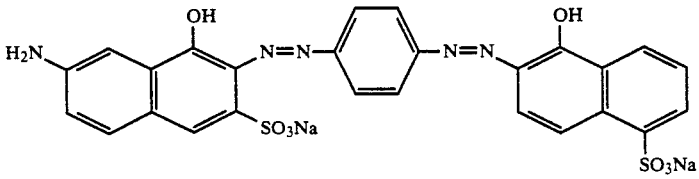

-continued
(34)
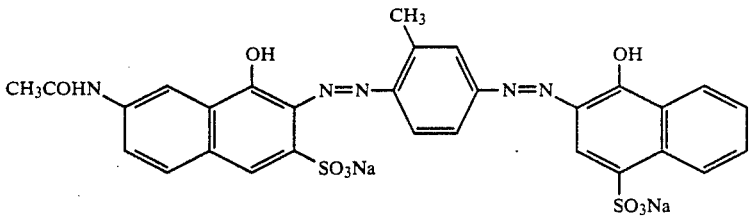
(35)
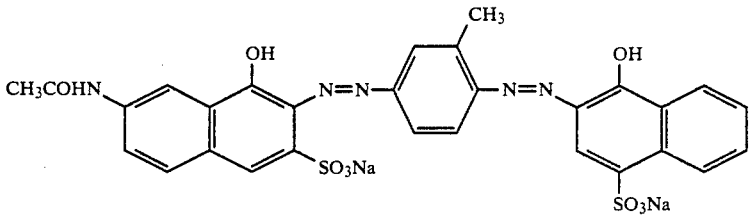
(36)
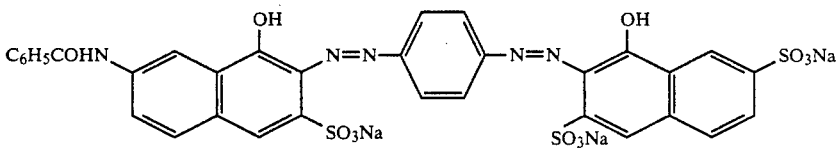
(37)
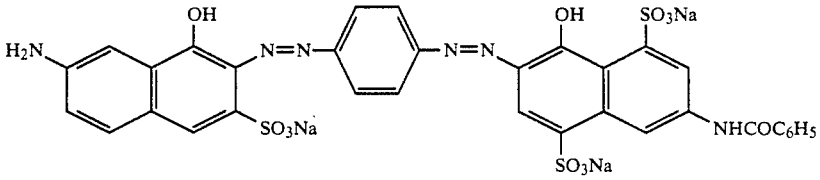
(38)
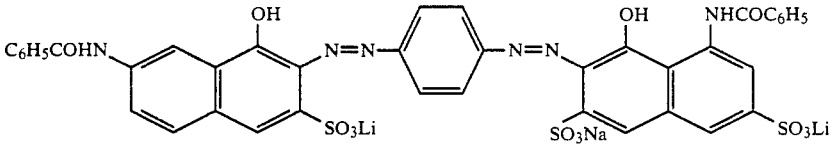
(39)
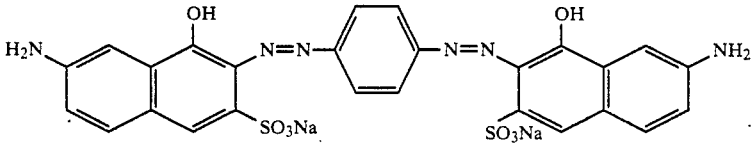
(40)
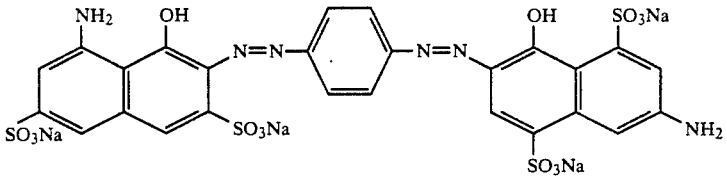
(41)
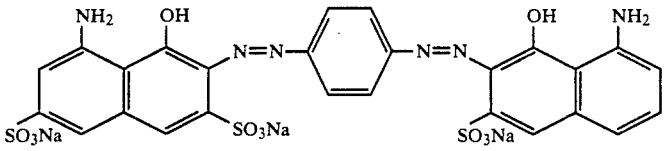
(42)
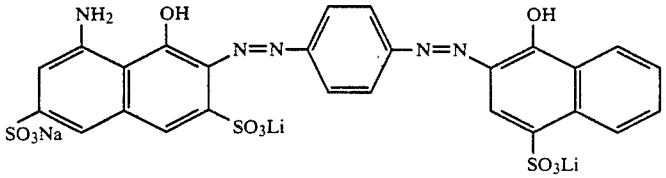

-continued
(43)
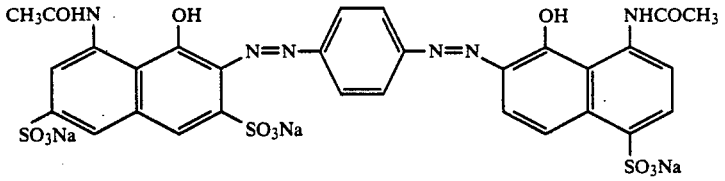
(44)
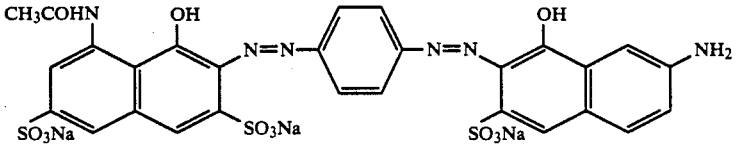
(45)
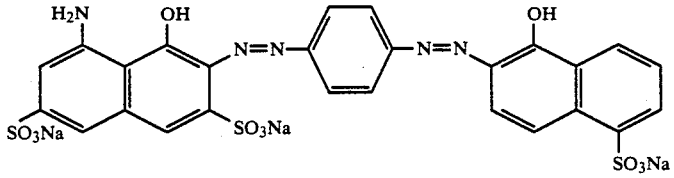
(46)
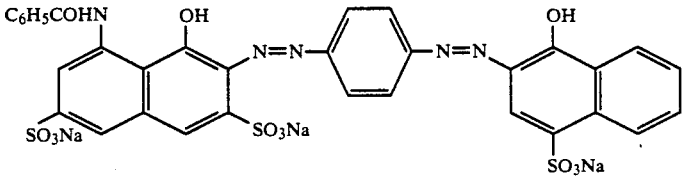
(47)
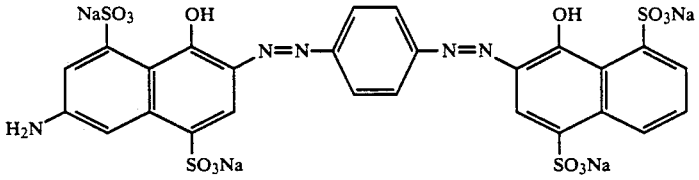
(48)
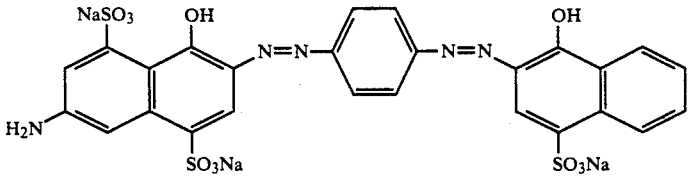
(49)
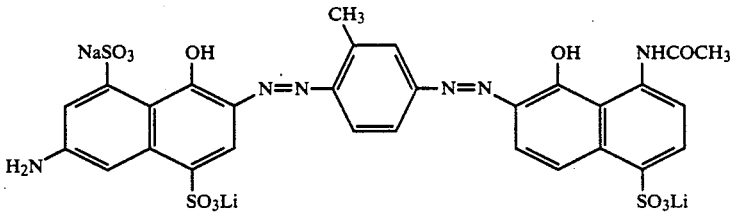
(50)
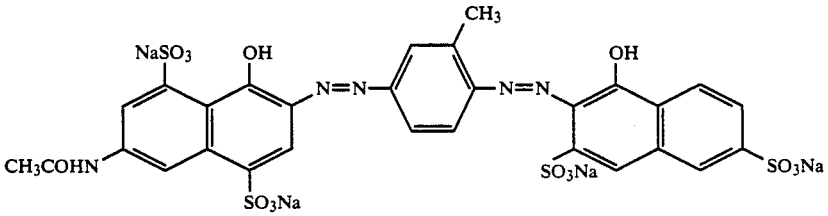

-continued
(51)
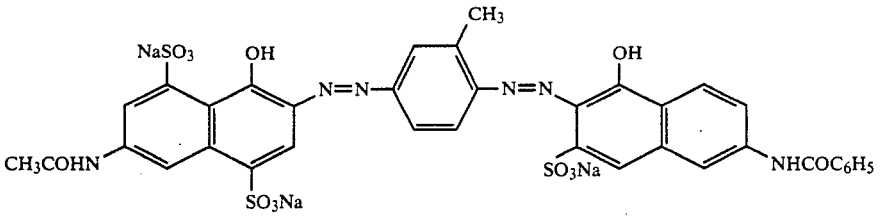
(52)
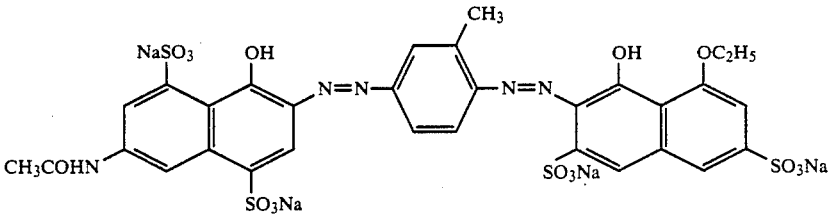
(53)
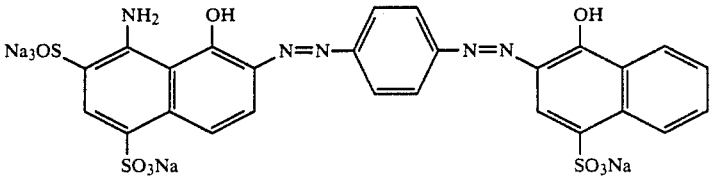
(54)
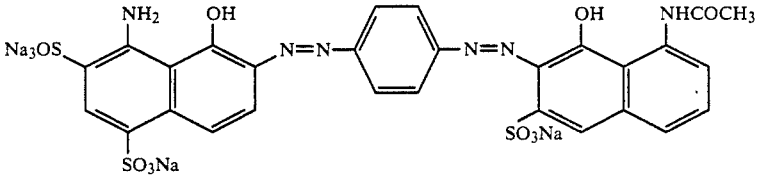
(55)
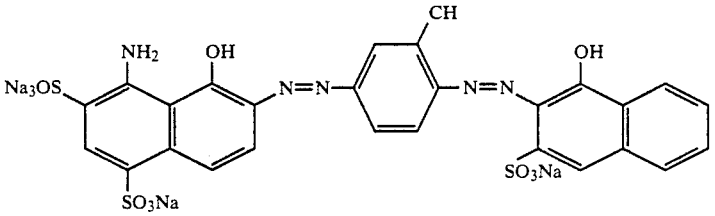
(56)
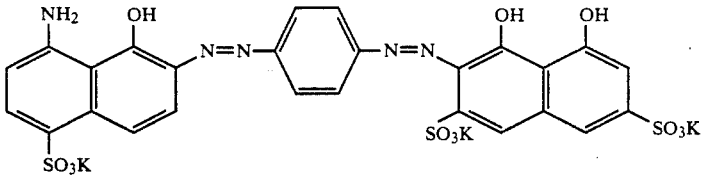
(57)
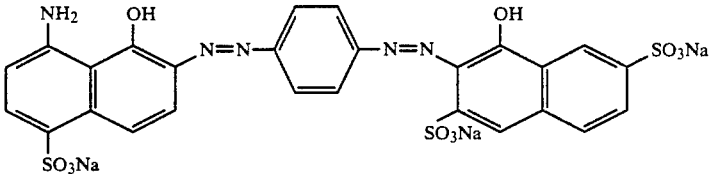
(58)
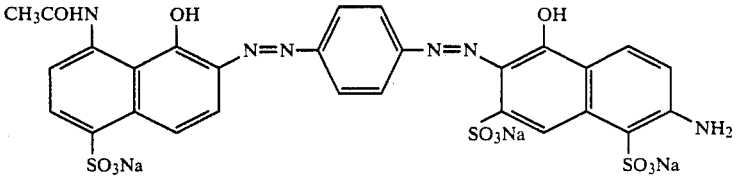

-continued
(59)
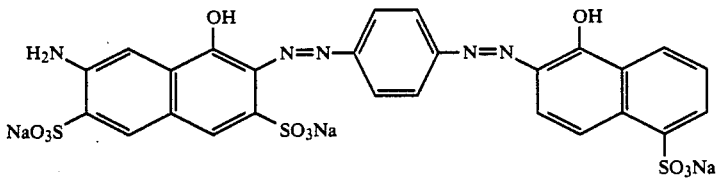
(60)
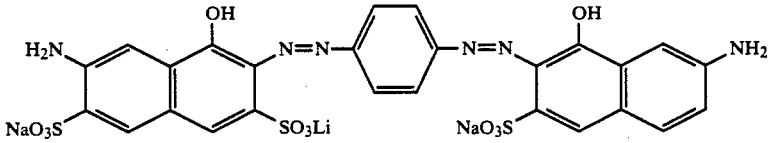
(61)
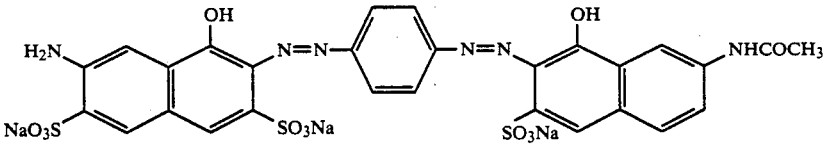
(62)
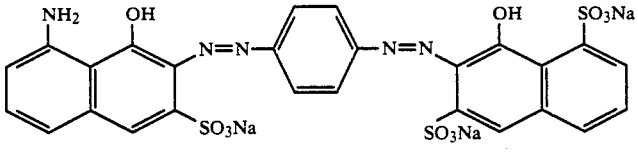
(63)
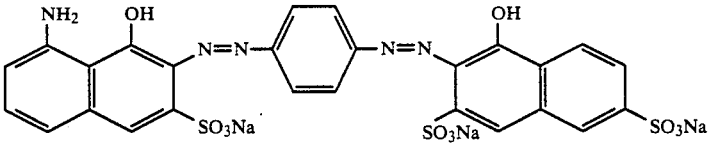
(64)
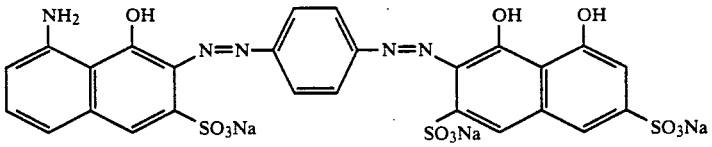
(65)
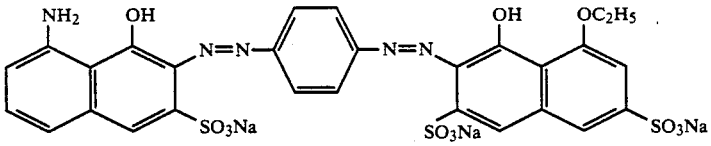
(66)
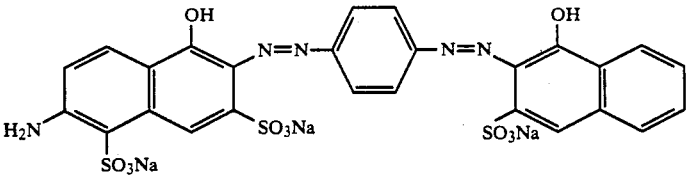
(67)
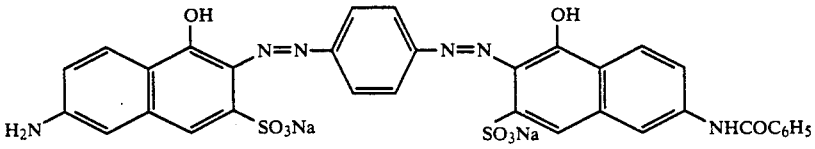

-continued (68)

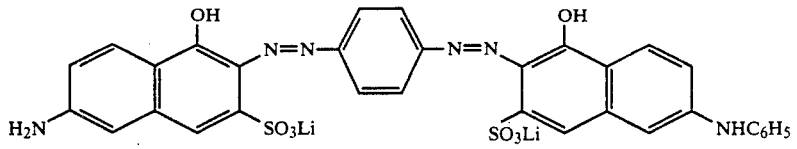

(69)

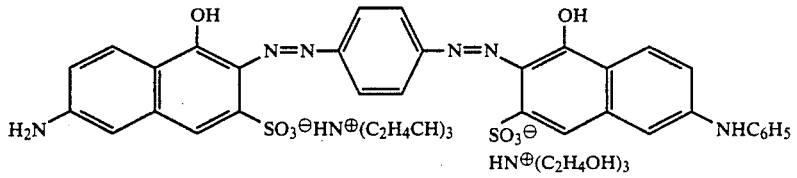

(70)

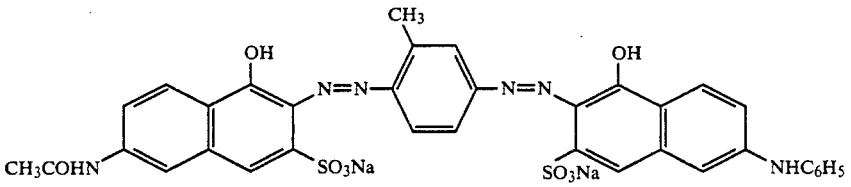

(71)

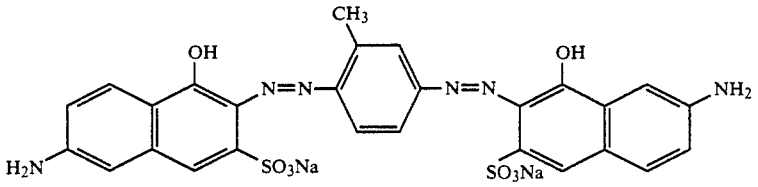

(72)

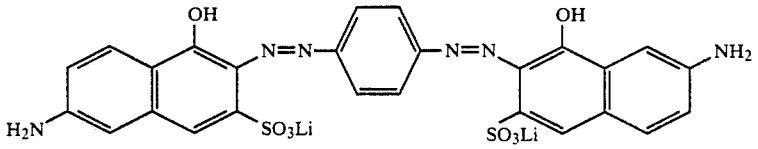

(73)

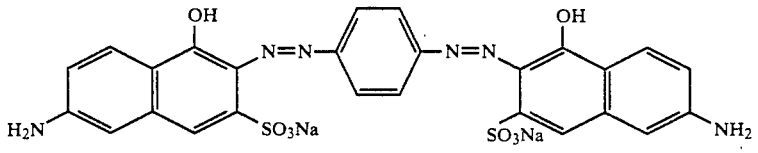

We claim:

1. Process for the coloring of paper, characterized in that dyestuffs of the formula (I)

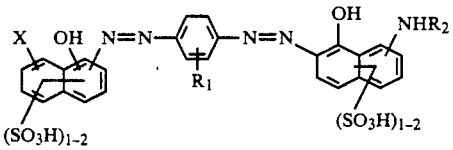

are used in which

X is H, OH, $C_1$–$C_4$-alkoxy or —$NHR_3$ $R_1$, $C_1$–$C_4$-alkyl $R_2$, $R_3$ are H, alkyl, alkylcarbonyl, alkylsulphonyl, aryl, arylcarbonyl, arylsulphonyl, aralkyl, aralkylcarbonyl or aminocarbonyl.

2. Process according to claim 1, characterized by the use of dyestuffs of the formula of claim 1 in which $R_1$ is H, $C_1$–$C_4$-alkyl, $R_2R_3$ are H, $C_1$–$C_4$-alkyl, $C_1$–$C_4$-alkylcarbonyl, $C_1$–$C_4$-alkylsulphonyl, aminocarbonyl, phenylcarbonyl, phenyl, phenylsulphonyl, benzylcarbonyl, it being possible for the phenyl rings, to be substituted by $SO_3H$ or COOH, X is H, $C_1$–$C_4$-alkoxy, —$NHR_3$, the dyestuffs having at least 3 sulpho groups in the naphthalene rings.

3. Process according to claim 1, characterized by the use of dyestuffs of the formula (II)

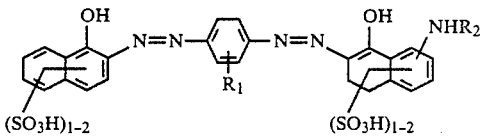

(III)

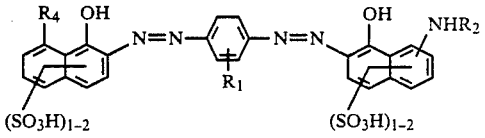

in which $R_4$ is OH, $OCH_3$, $OC_2H_5$, and (IV)

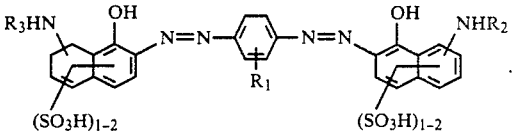

* * * * *

UNITED STATES PATENT AND TRADEMARK OFFICE

CERTIFICATE OF CORRECTION

PATENT NO. : 5,034,017

DATED : July 23, 1991

INVENTOR(S) : Kunde et al.

It is certified that error appears in the above-identified patent and that said Letters Patent is hereby corrected as shown below:

Col. 2, line 43 — Delete " $C_2$-$CH_2$-OH, " and substitute -- $CH_2$-$CH_2$-OH, --

Col. 2, lines 46-47 — Delete " $CH_{2-CH2}OCH_3$, and substitute -- $CH_2$-$CH_2OCH_3$, --

Col. 15-16 Formula — Delete "

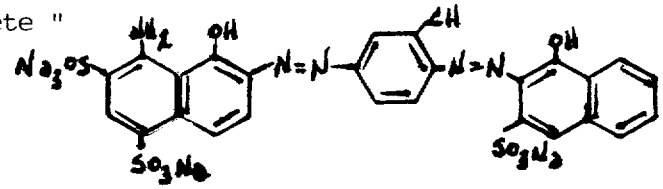

"

and substitute --

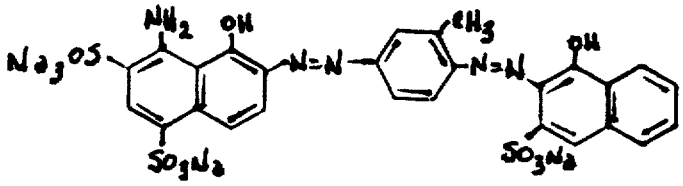

--

Col. 19, line 60 — After " $R_1$ " insert -- is H , --

UNITED STATES PATENT AND TRADEMARK OFFICE

CERTIFICATE OF CORRECTION

PATENT NO. : 5,034,017

DATED : July 23, 1991

INVENTOR(S) : Kunde, et. al.

It is certified that error appears in the above-identified patent and that said Letters Patent is hereby corrected as shown below:

Col. 19, line 66 Delete " $R_2R_3$" and substitute -- $R_2$, $R_3$ --

Signed and Sealed this

Twenty-fifth Day of May, 1993

Michael K. Kirk

*Attest:*

MICHAEL K. KIRK

*Attesting Officer*

*Acting Commissioner of Patents and Trademarks*